US009057141B2

(12) United States Patent
Barz et al.

(10) Patent No.: US 9,057,141 B2
(45) Date of Patent: Jun. 16, 2015

(54) IMMERSION TIN OR TIN ALLOY PLATING BATH WITH IMPROVED REMOVAL OF CUPROUS IONS

(75) Inventors: Iris Barz, Berlin (DE); Arnd Kilian, Berlin (DE); Markus Muskulus, Berlin (DE); Britta Schafsteller, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 240 days.

(21) Appl. No.: 13/880,080

(22) PCT Filed: Jan. 3, 2012

(86) PCT No.: PCT/EP2012/050052

§ 371 (c)(1), (2), (4) Date: Apr. 18, 2013

(87) PCT Pub. No.: WO2012/095334

PCT Pub. Date: Jul. 19, 2012

(65) Prior Publication Data

US 2013/0277226 A1 Oct. 24, 2013

(30) Foreign Application Priority Data

Jan. 13, 2011 (EP) ..... 11150878

(51) Int. Cl.

| | |
|---|---|
| ***C23C 18/31*** | (2006.01) |
| ***C23C 18/48*** | (2006.01) |
| ***C25D 3/30*** | (2006.01) |
| ***C23C 18/52*** | (2006.01) |
| ***C23C 18/54*** | (2006.01) |
| ***C25D 3/60*** | (2006.01) |

(52) U.S. Cl.

CPC . *C25D 3/30* (2013.01); *C23C 18/52* (2013.01); *C23C 18/54* (2013.01); *C25D 3/60* (2013.01)

(58) Field of Classification Search

CPC .... C23C 18/1601; C23C 18/31; C23C 18/48; C23C 18/52

USPC ..... 106/1.22, 1.25

See application file for complete search history.

(56) References Cited

U.S. PATENT DOCUMENTS

| | | | | |
|---|---|---|---|---|
| 4,027,055 | A * | 5/1977 | Schneble, Jr. | 106/1.25 |
| 4,194,913 | A * | 3/1980 | Davis | 106/1.22 |
| 4,550,037 | A * | 10/1985 | Kinkelaar et al. | 427/443.1 |
| 5,169,692 | A * | 12/1992 | Couble et al. | 106/1.25 |
| 5,173,109 | A * | 12/1992 | Iantosca | 106/1.22 |
| 5,196,053 | A * | 3/1993 | Dodd et al. | 106/1.25 |
| 5,266,103 | A * | 11/1993 | Uchida et al. | 106/1.22 |
| 6,063,172 | A * | 5/2000 | Bokisa et al. | 106/1.25 |
| 6,726,827 | B2 * | 4/2004 | Khaselev et al. | 106/1.22 |
| 6,860,925 | B2 * | 3/2005 | Soutar et al. | 106/1.22 |
| 2006/0113006 | A1 * | 6/2006 | Masuda et al. | 148/270 |
| 2007/0007144 | A1 * | 1/2007 | Schetty, III | 205/300 |
| 2012/0132530 | A1 * | 5/2012 | Hayashi et al. | 205/125 |

FOREIGN PATENT DOCUMENTS

| | | |
|---|---|---|
| JP | 2003041376 | 2/2003 |
| JP | 2003342743 | 12/2003 |
| JP | 2004068056 | 3/2004 |

OTHER PUBLICATIONS

PCT/EP2012/050052; PCT International Search Report and Written Opinion of the International Searching Authority dated Apr. 25, 2012.

* cited by examiner

*Primary Examiner* — Helene Klemanski

(74) *Attorney, Agent, or Firm* — Renner, Otto, Boisselle & Sklar, LLP

(57) ABSTRACT

The invention concerns an immersion tin plating bath which comprises at least one aromatic sulfonic acid, at least one first precipitation additive and at least one second precipitation additive. The at least one first precipitation additive is an aliphatic poly-alcohol compound, an ether thereof or a polymer derived thereof having an average molecular weight in the range of 62 g/mol and 600 g/mol. The at least one second precipitation additive is a polyalkylene glycol compound having an average molecular weight in the range of 750 to 10,000 g/mol.

15 Claims, No Drawings

IMMERSION TIN OR TIN ALLOY PLATING BATH WITH IMPROVED REMOVAL OF CUPROUS IONS

The present application is a U.S. National Stage Application based on and claiming benefit and priority under 35 U.S.C. §371 of International Application No. PCT/EP2012/050052, filed 3 Jan. 2012, which in turn claims benefit of and priority to European Application No. EP 11150878.4, filed 13 Jan. 2011, the entirety of each of which is hereby incorporated herein by reference.

FIELD OF THE INVENTION

The invention relates to an immersion tin or tin alloy plating bath with an improved precipitation of a cuprous thiourea complex. The immersion tin or tin alloy plating bath is particularly useful for deposition of tin or tin alloy layers in the manufacture of printed circuit boards, IC substrates, semiconductor devices and the like.

BACKGROUND OF THE INVENTION

The addition of a complexant such as thiourea or derivatives thereof is required whenever tin or a tin alloy is deposited by an immersion plating process on copper substrates. The role of thiourea is to support the dissolution of copper by forming Cu(I) thiourea complexes during the immersion reaction with Sn(II) ions. As copper is more noble than tin such a support reaction is required to reduce Sn(II) ions by oxidation of copper.

On the other hand the concentration of Cu(I) ions and Cu(I) thiourea complex is increased in the plating bath during use of a tin or tin alloy immersion plating process. When saturation of the Cu(I) thiourea complex in the immersion tin plating bath is exceeded said Cu(I) thiourea complex starts to form undesired precipitations in the plating equipment, e.g., in spray nozzles and other mechanical components.

Furthermore, copper ions in an immersion tin plating bath can reverse the desired reaction of tin deposition, i.e., by dissolving the tin layer and deposition of metallic copper.

Acidic immersion tin plating baths comprising thiourea or derivatives thereof are known since a long time (The Electrodeposition of Tin and its Alloys, M. Jordan, Eugen G. Leuze Publishers, 1995, pages 89 to 90 and references cited therein).

An acidic immersion tin plating bath comprising thiourea and optionally a surfactant which can be a polyalkylene glycol compound is disclosed in JP 9-302476 A. A Cu(I) thiourea complex precipitated from such plating bath compositions lead to voluminous precipitates which tend to block spray nozzles, filters and other mechanical components of the plating equipment during use of the plating bath and during removal of the precipitated complex. Furthermore, the formation of a Cu(I) thiourea complex compounds from dissolved Cu(I) ions in the plating bath is not completely. Dissolved Cu(I) ions remain in the plating bath at all times during use. Said free Cu(I) ions in the plating bath are prone to reverse tin deposition. This effect is problematic in case the deposited tin layer should serves to provide a solderable or bondable surface for electronic devices.

A method to remove precipitates of a Cu(I) thiorurea complex from acidic immersion tin plating baths is disclosed in U.S. Pat. No. 5,211,831 wherein a portion of a immersion tin plating bath in use is transferred from the plating tank to a separate crystallization unit. The still dissolved Cu(I) thiourea complex is selectively precipitated in the separate crystallization unit by cooling down said portion and the remaining tin plating bath portion is transferred back to the plating tank. Such methods comprise a filtration step wherein the precipitated Cu(I) thiourea complex is removed from the immersion tin plating bath by filtering off the precipitate.

OBJECT OF THE INVENTION

It is the object of the present invention to provide an aqueous immersion tin or tin alloy plating bath which allows deposition of tin or tin alloy layers of sufficient quality for bonding and soldering applications, the plating bath having an extended bath lifetime while maintaining a high tin deposition speed of 0.05 to 0.1 μm/min.

Furthermore, it is the object of the present invention to provide an aqueous immersion tin or tin alloy plating bath which forms at a given concentration of dissolved copper ions in the immersion plating bath precipitates of a Cu(I) thiourea complex which are more compact and less voluminous, i.e., easier to filter off than the Cu(I) thiourea complex precipitate derived from immersion tin plating baths known in the art.

Furthermore, it is the object of the present invention to provide an aqueous immersion tin or tin alloy plating bath which more rapidly forms precipitates of Cu(I) thiourea complex during cooling down in, e.g., a crystallization unit for filtering-off said precipitates.

SUMMARY OF THE INVENTION

This objects are solved by an aqueous immersion tin or tin alloy plating bath comprising Sn(II) ions, at least one aromatic sulfonic acid or salt thereof, thiourea or a derivative thereof and a mixture of at least two precipitation additives. The at least one first precipitation additive is an aliphatic poly-alcohol compound, ethers thereof or a polymer derived thereof having an average molecular weight in the range of 62 g/mol (molecular weight of ethylene glycol) and 600 g/mol. The at least one second precipitation additive is a polyalkylene glycol compound having an average molecular weight in the range of 750 to 10,000 g/mol. The concentration of the at least one second precipitation additive ranges from 1 to 10 wt.-% based on the total amount of the at least one first precipitation additive and the at least one second precipitation additive.

Furthermore, a plating bath solution made of a plating bath concentrate shows under working conditions, i.e., with dissolved copper ions present, an improved precipitation of a Cu(I) thiourea complex. The same or even higher amount of undesired Cu(I) ions are removed faster by precipitation of a Cu(I) thiourea complex as compared with state of the art immersion tin plating baths. However, at the same time the volume of a Cu(I) thiourea complex precipitate formed is reduced and it is therefore easier to filter-off from the plating bath during use of said plating bath.

The more compact and less voluminous Cu(I) thiourea complex precipitate is further less prone to block parts of the plating equipment such as spray nozzles and other mechanical components.

This effect of improved removal of Cu(I) ions by faster precipitation and of less voluminous Cu(I) thiourea complex precipitates from the plating bath leads to an extended bath life time while still enabling the deposition of the tin or tin alloy layer suitable to serve as a solderable and bondable surface while reaching a high deposition rate for a tin or tin alloy layer of 0.05 to 0.1 μm/min.

DETAILED DESCRIPTION OF THE INVENTION

The invention provides an aqueous immersion tin or tin alloy plating bath comprising (i) Sn(II) ions,
(ii) optionally ions of an alloying metal,
(iii) at least on aromatic sulfonic acid or salt thereof,
(iv) at least one complexant selected from the group consisting of thiourea and derivatives thereof and
(v) a mixture of at least one first precipitation additive and at least one second precipitation additive wherein at least one first precipitation additive is an aliphatic poly-alcohol compound or a polymer derived thereof having an average molecular weight in the range of 62 g/mol and 600 g/mol, more preferred in the range of 62 g/mol and 500 g/mol. The at least one second precipitation additive is selected from the group consisting of polyalkylene glycol compounds having an average molecular weight in the range of 750 to 10,000 g/mol, more preferred of 800 to 2,000 g/mol.

The term aliphatic poly-alcohol compound is defined herein as saturated aliphatic compounds having at least two hydroxyl moieties but no other functional groups attached. Aliphatic poly-alcohol compounds in accordance with the present invention are for example ethylene glycol and propylene glycol.

The at least one first precipitation additive is selected from the group consisting of ethylene glycol, propylene glycol, diethylene glycol, dipropylene glycol, triethylene glycol, tripropyleneglycol, ethylene glycol monoethyl ether, ethylene glycol monobutyl ether, propylene glycol monomethyl ether, propylene glycol monoethyl ether, propylene glycol monobutyl ether, diethylene glycol monomethyl ether, diethylene glycol monoethyl ether, diethylene glycol monopropyl ether, diethylene glycol monobutyl ether, dipropylene glycol monomethyl ether, dipropylene glycol monoethyl ether, dipropylene glycol monopropyl ether, dipropylene glycol monobutyl ether, triethylene glycol monomethyl ether, triethylene glycol monoethyl ether, triethylene glycol monopropyl ether, triethylene glycol monobutyl ether, tripropylene glycol monomethyl ether, tripropylene glycol monoethyl ether, tripropylene glycol monopropyl ether and tripropylene glycol monobutyl ether, polyethylene glycol, polypropylene glycol, polyethylene glycol dimethylether, polyethylene glycol diethylether, polyethylene glycol dipropylether, polypropylene glycol dimethylether, polypropylene glycol diethylether, polypropylene glycol dipropyl ether, stearic acid polyglycol ester, oleic acid polyglycol ester, stearic alcohol polyglycol ether, nonylphenol polyglycol ether, octanol polyalkylene glycol ether, octane diol-bis-(polyalkylene glycol ether), poly(ethylene glycol-ran-propylene glycol), poly(ethylene glycol)-blockpoly(propylene glycol)-block-poly(ethylene glycol) and poly(propylene glycol)block-poly(ethylene glycol)-block-poly(propylene glycol).

Polyethylene glycol and polypropylene glycol having an average molecular weight in the range of 62 g/mol and 600 g/mol are the preferred first precipitation additive in the mixture of at least one first precipitation additive and at least one second precipitation additive.

Polyethylene glycol having an average molecular weight of not more than 600 g/mol is the most preferred first precipitation additive in the mixture of at least one first precipitation additive and at least one second precipitation additive.

The at least one second precipitation additive is selected from the group consisting of polyethylene glycol, polypropylene glycol, polyethylene glycol dimethylether, polyethylene glycol diethylether, polyethylene glycol dipropylether, polypropylene glycol dimethylether, polypropylene glycol diethylether, polypropylene glycol dipropyl ether, stearic acid polyglycol ester, oleic acid polyglycol ester, stearic alcohol polyglycol ether, nonylphenol polyglycol ether, octanol polyalkylene glycol ether, octane diol-bis-(polyalkylene glycol ether), poly(ethylene glycol-ran-propylene glycol), poly(ethylene glycol)-block-poly(propylene glycol)-block-poly(ethylene glycol) and poly(propylene glycol)block-poly(ethylene glycol)-block-poly(propylene glycol) having an average molecular weight of 750 to 10000 g/mol.

Polyethylene glycol and polypropylene glycol having an average molecular weight in the range of 750 to 10,000 g/mol are the preferred second precipitation additive.

Polyethylene glycol having an average molecular weight in the range of 750 to 10,000 g/mol is the most preferred second precipitation additive in the mixture of at least one first precipitation additive and at least one second precipitation additive.

The overall concentration of all precipitation additives in the mixture of at least one first precipitation additive and at least one second precipitation additive ranges from 10 to 300 g/l, more preferably from 100 to 200 g/l.

The amount of second precipitation additive ranges from 1 to 10 wt.-% based on the total amount of the at least one first precipitation additive and the at least one second precipitation additive, more preferably from 2 to 5 wt.-%.

The source of Sn(II) ions in the immersion plating bath is limited only to water soluble compounds. Preferred sources of Sn(II) compounds are selected from the group comprising organic sulfonates of Sn(II) such as tin methane sulfonate, tin sulfate and tin chloride.

The amount of Sn(II) ions in the immersion plating bath ranges from 1 to 30 g/l, more preferably from 5 to 15 g/l.

The at least one complexant in the immersion plating bath is selected from the group consisting of thiourea and derivatives thereof. Thiourea derivatives are selected from the group comprising mono- and di-alkyl thiourea having an alkyl group of $C_1$ to $C_3$. The most preferred complexant is thiourea.

The at least one complexant which is selected from thiourea and derivatives thereof is added to the plating bath in an amount of 50 to 150 g/l, more preferably in an amount of 90 to 120 g/l.

The at least one aromatic sulfonic acid or salt thereof in the immersion plating bath is selected from compounds according to formula 1:

$$(R—SO_3)_aX \quad (1)$$

wherein R is selected from the group consisting of substituted and unsubstituted phenyl, substituted and unsubstituted benzyl and substituted and unsubstituted naphthyl and X is selected from the group consisting of $H^+$, $Li^+$, $Na^+$, $NH_4^+$, $K^+$ and $Sn^{2+}$. The coefficient a is a=1 in case of X=$H^+$, $Li^+$, $Na^+$, $NH_4^+$ and $K^+$ and a=2 in case of X=$Sn^{2+}$.

The substituents for residues phenyl, benzyl and napthyl as residue R are selected from the group consisting of methyl, ethyl, propyl, —OH, —$OR^1$, —COOH, —$COOR^1$, —$SO_3H$ and —$SO_3R^1$ wherein $R^1$ is selected from the group consisting of $Li^+$, $Na^+$, $NH_4^+$, $K^+$, methyl, ethyl and propyl.

Preferred aromatic sulfonic acids are selected from the group consisting of benzene sulfonic acid, benzyl sulfonic acid, o-toluene sulfonic acid, m-toluene sulfonic acid, p-toluene sulfonic acid, xylene sulfonic acid, naphthyl sulphonic acid and their salts with a counter ion selected from the group consisting of $Li^+$, $Na^+$, $NH_4^+$, $K^+$ and $Sn^{2+}$.

The concentration of the at least one aromatic sulfonic acid or salt thereof in the immersion plating bath ranges from 0.1 to 1.5 mol/l, more preferably from 0.3 to 1.2 mol/l and most preferably from 0.5 to 1.0 mol/l. In case a salt of an aromatic sulfonic acid is used, the contribution of the counterion is not taken into account for determining the concentration of the at least one aromatic sulfonic acid or salt thereof.

In a more preferred embodiment a mixture of at least one aromatic sulfonic acid and at least one non-aromatic sulfonic acid is added to the immersion plating bath according to the present invention.

The at least one non-aromatic sulfonic acid is selected from the group consisting of methane sulfonic acid, methane disulfonic acid, methane trisulfonic acid, ethane sulfonic acid, propane sulfonic acid, 2-propane sulfonic acid, 1,3-propane disulfonic acid, butane sulfonic acid, 2-butane sulfonic acid and pentane sulfonic acid and their salts with a counter ion selected from the group consisting of $Li^+$, $Na^+$, $NH_4^+$, $K^+$ and $Sn^{2+}$.

The overall concentration of the at least one aromatic sulfonic acid or the mixture of at least one aromatic sulfonic acid and at least one non-aromatic sulfonic acid in the immersion plating bath ranges from 0.1 to 1.5 mol/l, more preferably from 0.3 to 1.2 mol/l and most preferably from 0.5 to 1.0 mol/l.

In case a mixture of at least one aromatic sulfonic acid and at least one non-aromatic sulfonic acid is used, the concentration of the at least one aromatic sulfonic acid is at least 25 wt.-% based on the total amount of the at least one aromatic sulfonic acid and the at least one non-aromatic sulfonic acid, more preferably at least 50 wt.-% and most preferably at least 60 wt.-%.

Optionally, the immersion plating bath further contains Ag(I) ions in a concentration of 0.1 to 500 mg/l, more preferably 0.5 to 250 mg/l and most preferably from 1 to 50 mg/l.

The source of Ag(I) ions can be any water soluble Ag(I) salt. Preferred sources of Ag(I) ions are selected from the group consisting of silver sulphate and silver salts of methane sulfonic acid, methane disulfonic acid, methane trisulfonic acid, ethane sulfonic acid, propane sulfonic acid, 2-propane sulfonic acid, 1,3-propane disulfonic acid, butane sulfonic acid, 2-butane sulfonic acid, pentane sulfonic acid, aryl sulfonic acid, benzene sulfonic acid, toluene sulfonic acid and xylene sulfonic acid.

Optionally, the immersion plating bath further contains at least one second complexant selected from the group consisting of mono carboxylic acids, poly carboxylic acids, hydroxy carboxylic acid, amino carboxylic acids and salts thereof. Suitable cations in case a salt is used are $Li^+$, $Na^+$, $K^+$ and $NH_4^+$.

Mono carboxylic acids are defined here as compounds having one carboxyl moiety per molecule. Poly carboxylic acids are carboxylic acids having more than one carboxyl moiety per molecule. Hydroxylcarboxylic acids are carboxylic acids having at least one carboxyl and at least one hydroxyl moiety per molecule. Amino carboxylic acids are carboxylic acids having at least one carboxyl and at least one amine moiety. The amine moiety can be a primary, secondary or tertiary amine moiety.

Preferred poly carboxylic acids as the optional second complexant are selected from the group consisting of oxalic acid, malonic acid and succinic acid.

Preferred hydroxy carboxylic acids as the optional second complexant are selected from aliphatic hydroxy carboxylic acids having an alkyl group of $C_1$ to $C_6$. The most preferred hydroxy carboxylic acids as the optional second complexants are selected from the group consisting of glycolic acid, lactic acid, citric acid, tartaric acid and salts thereof.

Preferred amino carboxylic acids as the optional second complexant are selected from the group consisting of glycine, ethylenediamine tetraacetic acid (EDTA), diethylenetriamine pentaacetic acid (DTPA) and triethylenetetramine hexaacetic acid (TTNA).

The concentration of the optional second complexant ranges from 0.1 to 100 g/l, more preferably from 40 to 70 g/l.

Optionally, the immersion plating bath further contains a hypophosphite compound. The preferred hypophosphite compounds are sodium hypophosphite, potassium hypophosphite and ammonium hypophosphite.

The concentration of the optional hypophosphite compound ranges from 0.1 to 200 g/l, more preferably from 1 to 150 g/l and most preferably from 10 to 120 g/l.

The immersion tin or tin alloy plating bath according to the present invention is particularly useful for deposition of tin and tin-silver alloys onto copper surfaces.

The substrate to be coated is for example first cleaned in an acidic cleaner, micro etched and then immersed in the immersion tin or tin alloy plating bath according to the present invention. The temperature of the immersion tin or tin alloy plating bath during use ranges from 60 to 85° C. The substrate immersion time in the immersion tin plating bath ranges from 1 to 60 min.

During deposition of tin or a tin alloy the concentration of copper ions in the plating bath increases. Cu(I) ions and thiourea form a complex in the plating bath.

In one embodiment of the present invention a steady stream of plating bath liquid is guided to a crystallization unit as disclosed in U.S. Pat. No. 5,211,831. The plating liquid is cooled down inside said crystallization unit which leads to a precipitation of the Cu(I) thiourea complex. The precipitate is filtered off and the plating liquid is guided back to the plating tank.

EXAMPLES

The invention will now be illustrated by reference to the following non-limiting examples.

Different first precipitation additives, second precipitation additives and mixtures of first and second precipitation additives were added in an overall amount of 179 g/l for each example to immersion tin plating bath stock solutions described below.

In order to simulate the effect of copper ions typically enriched in such plating baths during use in deposition of tin onto copper surfaces, the tin plating bath was made up using 500 ml/l of the immersion tin plating bath stock solutions. Next, an amount of 3 g/l of copper powder was added to the plating bath solutions (i.e., to the diluted plating bath stock solutions) in each example. After heating, the copper powder was oxidized and a sludge of metallic tin was formed. The tin sludge was filtered off and the clear plating bath samples containing different polyalkylene compounds or mixtures thereof were transferred to glass bottles of the same size. The Cu(I) thiourea complex precipitation was triggered by adding a few particles of yellow Cu(I) thiourea complex precipitate to each bottle. The plating bath samples were then stored for two weeks at room temperature (20 to 25° C.) and the height of the Cu(I) thiourea complex precipitate in the bottle was measured. The concentration of dissolved copper ions in the plating bath samples was also measured by titration. The concentration of dissolved copper ions after two weeks of storage ranged in all examples between 0.7 and 0.8 g/l. Despite the small measured differences in copper ion concentration in different samples the concentration of copper ions is considered as equal because of the analytical method used.

In case of comparative Examples 1 and 2 an immersion plating bath stock solution comprising methane sulfonic acid, thiourea and tin methane sulfonate was used. The stock-solution was free of aromatic sulfonic acids. Precipitation additives were added to said stock solution as given in the respective examples.

Example 1

Comparative 179 g/l of polyethylene glycol having an average molecular weight of 400 g/mol was added to the plating bath stock solution.

The tin plating bath was then made up using 500 ml/l of the plating bath stock solution and 70 ml of DI water.

The concentration of dissolved copper in the plating solution after two weeks of storage at room temperature remained unchanged within the accuracy of the analytical method used in respect to the amount added prior to the test.

A small amount of the Cu(I) thiourea complex precipitate was formed on the bottom of the bottle.

Example 2

Comparative 170.05 g/l of polyethylene glycol having an average molecular weight of 400 g/mol and 8.95 g/l of polyethylene glycol having an average molecular weight of 1000 g/mol were added to the plating bath stock solution.

The tin plating bath was then made up using 500 ml/l of the plating bath stock solution and 70 ml of DI water.

The concentration of dissolved copper in the plating solution after two weeks of storage at room temperature remained unchanged within the accuracy of the analytical method used in respect to the amount added prior to the test.

A small amount of the Cu(I) thiourea complex precipitate was formed on the bottom of the bottle.

In case of Examples 3 to 8 an immersion plating bath stock solution comprising p-toluene sulfonic acid, methane sulfonic acid, thiourea and tin methane sulfonate was used. The concentration of p-toluene sulfonic acid was 30 wt.-% in respect to the total amount of sulfonic acids and sulfonic acid anions added to the plating bath. Precipitation additives were added to said stock solution as given in the respective examples.

Example 3

Comparative 179 g/l of polyethylene glycol having an average molecular weight of 400 g/mol was added to the plating bath stock solution.

The tin plating bath was then made up using 500 ml/l of the plating bath stock solution and 70 ml of DI water.

The height of the Cu(I) thiourea complex precipitate in the plating bath solution after two weeks of storage at room temperature was 30 mm.

The concentration of dissolved copper in the plating solution after two weeks of storage at room temperature was 0.7 g/l.

Example 4

Comparative 179 g/l of polyethylene glycol having an average molecular weight of 1500 g/mol was added to the plating bath stock solution.

The plating bath stock solution showed a large amount of precipitated solids. Therefore, said stock solution composition failed the test.

Example 5

170.05 g/l of polyethylene glycol having an average molecular weight of 400 g/mol and 8.95 g/l of polyethylene glycol having an average molecular weight of 1000 g/mol were added to the plating bath stock solution.

The tin plating bath was then made up using 500 ml/l of the plating bath stock solution and 70 ml of DI water.

The height of the Cu(I) thiourea complex precipitate in the plating bath solution after two weeks of storage at room temperature was 12 mm.

The concentration of dissolved copper in the plating solution after two weeks of storage at room temperature was 0.8 g/l.

Example 6

170.05 g/l of polyethylene glycol having an average molecular weight of 400 g/mol and 8.95 g/l of polyethylene glycol having an average molecular weight of 1500 g/mol were added to the plating bath stock solution.

The tin plating bath was then made up using 500 ml/l of the plating bath stock solution and 70 ml of DI water.

The height of the Cu(I) thiourea complex precipitate in the plating bath solution after two weeks of storage at room temperature was 10 mm.

The concentration of dissolved copper in the plating solution after two weeks of storage at room temperature was 0.7 g/l.

Example 7

Comparative 10 l of a tin plating bath according to example 3 were heated to 70° C. which resembles a typical bath temperature during use of such a plating bath for deposition of tin. 3 g/l of copper were added as a powder to the plating bath. Next, the plating bath with copper loading was cooled down to 5° C. within 60 min. Meanwhile, the Cu(I) thiourea complex precipitate was settled and samples were taken after 10, 30 and 60 from the clear part of the plating bath above the Cu(I) thiourea complex precipitate for analysis of the content of dissolved copper ions. The concentrations of dissolved copper ions during cooling down are summarized in table 1.

TABLE 1 concentration of dissolved copper ions during cooling down of the plating bath from 70° C. to 5° C.:

| Concentration of dissolved copper ions [g/l] | Time of cooling down [min] |
|---|---|
| 3 | 0 |
| 2.2 | 10 |
| 1.65 | 30 |

Example 8

10 l of a tin plating bath according to example 5 were heated to 70° C. which resembles a typical bath temperature during use of such a plating bath for deposition of tin. 3 g/l of copper were added as a powder to the plating bath. Next, the plating bath with copper loading was cooled down to 5° C. within 60 min. Meanwhile, the Cu(I)-thiourea complex precipitate was settled and samples were taken after 10, 30 and 60 from the clear part of the plating bath above the Cu(I) thiourea complex precipitate for analysis of the content of dissolved copper ions.

The concentrations of dissolved copper ions during cooling down are summarized in table 2.

TABLE 2 concentration of dissolved copper ions during cooling down of the plating bath from 70° C. to 5° C.:

| Concentration of dissolved copper ions [g/l] | Time of cooling down [min] |
|---|---|
| 3 | 0 |
| 1.4 | 10 |
| 1.3 | 30 |

The faster decrease of dissolved copper ion concentration during cooling down of the plating bath according to the present invention corresponds with a faster formation of the Cu(I) thiourea complex precipitate compared to a plating bath known from prior art (comparative example 7).

At the same time the Cu(I) thiourea complex precipitate formed during cooling down is less voluminous (example 5) than that formed from a plating bath known in the art (comparative example 3).

Therefore, removal of dissolved copper ions from a plating bath according to the present invention is faster and at the same time leading to a Cu(I) thiourea complex precipitate which is more compact and thus easier to filter-off from the plating bath.

The invention claimed is:

1. An aqueous immersion tin or tin alloy plating bath comprising (i) Sn(II) ions, (ii) optionally ions of an alloying metal, (iii) at least one aromatic sulfonic acid or salt thereof, (iv) at least one complexant selected from the group consisting of thiourea and derivatives thereof and (v) a mixture of at least one first precipitation additive and at least one second precipitation additive, wherein the at least one first precipitation additive is selected from the group consisting of aliphatic polyalcohol compounds, ethers thereof and polymers derived thereof having an average molecular weight in the range of 62 g/mol and 600 g/mol and wherein the at least one second precipitation additive is selected from the group consisting of polyalkylene glycol compounds having an average molecular weight in the range of 750 to 10,000 g/mol.

2. An immersion tin or tin alloy plating bath according to claim 1 wherein the concentration of the at least one second precipitation additive ranges from 1 to 10 wt.-% based on the total amount of the at least one first precipitation additive and the at least one second precipitation additive.

3. An immersion tin or tin alloy plating bath according to claim 1 wherein the at least one first precipitation additive is selected from the group consisting of ethylene glycol, propylene glycol, diethylene glycol, dipropylene glycol, triethylene glycol, tripropyleneglycol, ethylene glycol monoethyl ether, ethylene glycol monobutyl ether, propylene glycol monomethyl ether, propylene glycol monoethyl ether, propylene glycol monobutyl ether, diethylene glycol monomethyl ether, diethylene glycol monoethyl ether, diethylene glycol monopropyl ether, diethylene glycol monobutyl ether, dipropylene glycol monomethyl ether, dipropylene glycol monoethyl ether, dipropylene glycol monopropyl ether, dipropylene glycol monobutyl ether, triethylene glycol monomethyl ether, triethylene glycol monoethyl ether, triethylene glycol monopropyl ether, triethylene glycol monobutyl ether, tripropylene glycol monomethyl ether, tripropylene glycol monoethyl ether, tripropylene glycol monopropyl ether and tripropylene glycol monobutyl ether, polyethylene glycol, polypropylene glycol, polyethylene glycol dimethylether, polyethylene glycol diethylether, polyethylene glycol dipropylether, polypropylene glycol dimethylether, polypropylene glycol diethylether, polypropylene glycol dipropyl ether, stearic acid polyglycol ester, oleic acid polyglycol ester, stearic alcohol polyglycol ether, nonylphenol polyglycol ether, octanol polyalkylene glycol ether, octane diol-bis-(polyalkylene glycol ether), poly(ethylene glycol-ran-propylene glycol), poly(ethylene glycol)-block-poly(propylene glycol)-block-poly(ethylene glycol) and poly(propylene glycol)-block-poly(ethylene glycol)-block-poly(propylene glycol.

4. An immersion tin or tin alloy plating bath according to claim 1 wherein the at least one first precipitation additive is selected from the group consisting of polyethylene glycol and polypropylene glycol.

5. An immersion tin or tin alloy plating bath according to claim 1 wherein the at least one second precipitation additive is selected from the group consisting of polyethylene glycol, polypropylene glycol, polyethylene glycol dimethylether, polyethylene glycol diethylether, polyethylene glycol dipropylether, polypropylene glycol dimethylether, polypropylene glycol diethylether, polypropylene glycol dipropyl ether, stearic acid polyglycol ester, oleic acid polyglycol ester, stearic alcohol polyglycol ether, nonylphenol polyglycol ether, octanol polyalkylene glycol ether, octane diol-bis-(polyalkylene glycol ether), poly(ethylene glycol-ran-propylene glycol), poly(ethylene glycol)-block-poly(propylene glycol)-block-poly(ethylene glycol) and poly(propylene glycol)-block-poly(ethylene glycol)-block-poly(propylene glycol).

6. An immersion tin or tin alloy plating bath according to claim 1 wherein the at least one second precipitation additive is selected from the group consisting of polyethylene glycol and polypropylene glycol.

7. An immersion tin or tin alloy plating bath according to claim 1 wherein the total concentration of the mixture of the at least one first precipitation additive and the at least one second precipitation additive ranges from 0.01 g/l to 200 g/l.

8. An immersion tin or tin alloy plating bath according to claim 1 wherein the at least one aromatic sulfonic acid is characterized by the formula $R—SO_3X$, wherein R is selected from the group consisting of substituted and unsubstituted phenyl, substituted and unsubstituted benzyl and substituted and unsubstituted naphthyl and X is selected from the group consisting of $H^+$, $Li^+$, $Na^+$, $NH_4^+$ and $K^+$.

9. An immersion tin or tin alloy plating bath according to claim 1 wherein the at least one aromatic sulfonic acid or salt thereof is selected from the group consisting of benzene sulfonic acid, benzyl sulfonic acid, o-toluene sulfonic acid, m-toluene sulfonic acid, p-toluene sulfonic acid, xylene sulfonic acid, naphthyl sulphonic acid and their salts with a counter ion selected from the group consisting of $Li^+$, $Na^+$, $NH_4^+$, $K^+$.

10. An immersion tin or tin alloy plating bath according to claim 1 wherein the overall concentration of the at least one aromatic sulfonic acid or salt thereof ranges from 0.1 to 1.5 mol/l.

11. An immersion tin or tin alloy plating bath according to claim 1 wherein the immersion tin plating bath further comprises at least one non-aromatic sulfonic acid or salt thereof selected from the group consisting of methane sulfonic acid, methane disulfonic acid, methane trisulfonic acid, ethane sulfonic acid, propane sulfonic acid, 2-propane sulfonic acid, 1,3-propane disulfonic acid, butane sulfonic acid, 2-butane sulfonic acid, pentane sulfonic acid and their salts with a counter ion selected from the group consisting of $Li^+$, $Na^+$, $NH_4^+$, $K^+$.

12. An immersion tin or tin alloy plating bath according to claim 1 wherein the concentration of the at least one aromatic sulfonic acid or salt thereof is at least 25 wt.-% based on the total amount of the at least one aromatic sulfonic acid and the at least one non-aromatic sulfonic acid.

13. An immersion tin or tin alloy plating bath according to claim 1 wherein the concentration of Sn(II) ions ranges from 1 to 50 g/l.

14. An immersion tin or tin alloy plating bath according to claim 1 wherein the plating bath further contains Ag(I) ions.

15. A process for depositing a tin or tin alloy layer onto copper surfaces comprising the steps of (i) Providing a copper surface, (ii) Contacting the copper surface with an immersion tin or tin alloy plating bath according to claim 1.

* * * * *